US008523250B2

(12) United States Patent
Chen et al.

(10) Patent No.: US 8,523,250 B2
(45) Date of Patent: Sep. 3, 2013

(54) TOP-AND-BOTTOM LATCH STRUCTURE FOR LOCK

(76) Inventors: Lynn Chiung-Ling Chen, Pingtung (TW); Te-Ming Chen, Pingtung (TW); Te-Yu Chen, Pingtung (TW)

( * ) Notice: Subject to any disclaimer, the term of this patent is extended or adjusted under 35 U.S.C. 154(b) by 310 days.

(21) Appl. No.: 12/960,565

(22) Filed: Dec. 6, 2010

(65) Prior Publication Data

US 2012/0139266 A1 Jun. 7, 2012

(51) Int. Cl.
*E05B 63/20* (2006.01)
*E05C 9/00* (2006.01)

(52) U.S. Cl.
USPC ..... 292/332; 292/32; 292/DIG. 21

(58) Field of Classification Search
USPC ..... 292/8, 32, 33, 37, 42, 332–336, DIG. 21
See application file for complete search history.

(56) References Cited

U.S. PATENT DOCUMENTS

| | | | | | |
|---|---|---|---|---|---|
| 228,323 | A * | 6/1880 | Crandal | 292/333 |
| 1,047,900 | A * | 12/1912 | Voight | 292/336 |
| 1,070,365 | A * | 8/1913 | Voight | 292/47 |
| 1,071,656 | A * | 8/1913 | Voight | 292/333 |
| 1,355,735 | A * | 10/1920 | Crompton et al. | 292/164 |
| 1,362,217 | A * | 12/1920 | Baxter | 292/333 |
| 1,367,855 | A * | 2/1921 | Bolles | 292/333 |
| 1,635,714 | A * | 7/1927 | Hoffmann | 70/118 |
| 1,707,978 | A * | 4/1929 | Geschickter | 292/37 |
| 1,977,901 | A * | 10/1934 | Tolle | 292/173 |
| 3,578,369 | A * | 5/1971 | Coopersmith | 292/58 |
| 3,801,144 | A * | 4/1974 | Diehl | 292/92 |
| 3,822,506 | A * | 7/1974 | Fishbach | 49/367 |
| 4,005,886 | A * | 2/1977 | Lirette | 292/177 |
| 4,099,753 | A * | 7/1978 | Gwozdz et al. | 292/177 |
| 4,478,444 | A * | 10/1984 | Kurz et al. | 292/333 |
| 5,531,492 | A * | 7/1996 | Raskevicius | 292/335 |
| 6,217,087 | B1 * | 4/2001 | Fuller | 292/39 |
| 6,813,915 | B2 * | 11/2004 | Chang | 70/107 |
| 7,322,619 | B2 * | 1/2008 | Nolte et al. | 292/175 |
| 7,377,076 | B2 * | 5/2008 | Shedd | 49/449 |

* cited by examiner

*Primary Examiner* — Carlos Lugo
(74) *Attorney, Agent, or Firm* — Leong C. Lei

(57) ABSTRACT

A top-and-bottom latch structure for a lock mainly includes a lock formed by a casing, and a lock tongue, a lock core, a handle spindle, and other components disposed in the casing. The handle spindle is provided with a first and a second protruding rod disposed at different angles, and is respectively provided with a first and a second braking piece above and under the handle spindle, so that the two braking pieces are respectively clamped by the protruding rods. The top-and-bottom latch structure for a lock further includes: two fixing members, respectively connected to the braking pieces; and tact switches, connected to a door panel by the fixing members via connecting rods. Therefore, when the door is closed, the tact switches once touching the door frame are embedded into the door frame and the fixing members move downwards to rotate the handle spindle and lock the lock tongue.

3 Claims, 5 Drawing Sheets

TOP-AND-BOTTOM LATCH STRUCTURE FOR LOCK

BACKGROUND OF THE INVENTION (a) Technical Field of the Invention

The present invention relates to a top-and-bottom latch structure for a lock. More particularly, the present invention relates to a top-and-bottom latch structure, which enables a lock to have top-and-bottom latch effects, thereby improving the safety of the lock.

(b) Description of the Prior Art

Accordingly, besides a large lock tongue, triangle lock tongue, and small lock tongue, a conventional lock structure further includes a latch interlocked with the small lock tongue. When the lock is turned by a knob or a key in the normal state, the lock is in the lock-on state by the lock tongue. For the conventional lock, in addition to the lock tongue embedded in the door frame to form the closed state, the conventional lock has another auxiliary locking device. Although a top-and-bottom latch may be used together with the lock, the top-and-bottom latch cannot be interlocked with the lock, so that the installation and operation are rather complicated. In view of the above problem, the applicant has developed a lock having the top-and-bottom latch effect after making continuous research and experiments based on years of experience.

SUMMARY OF THE INVENTION

Accordingly, an objective of the present invention is to provide a top-and-bottom latch structure for a lock, which enables the lock in use to have the locking effect of the top-and-bottom latch, thereby improving the safety of the lock.

The top-and-bottom latch structure for a lock includes a lock formed by a casing, and a lock tongue, a lock core, a handle spindle, and other components disposed in the casing. The handle spindle is provided with a first and a second protruding rod disposed at different angles, and a first and a second braking piece is respectively disposed above and under the handle spindle, so that the two braking pieces are respectively clamped by the protruding rods. The top-and-bottom latch structure for a lock further includes: two fixing members, respectively connected to the braking pieces, and tact switches, connected to a door panel by the fixing members via connecting rods. Therefore, when the door is closed, the tact switches once touching the door frame are embedded into the door frame and the fixing members move downwards to rotate the handle spindle and lock the lock tongue. When the handle spindle is pressed down, the lock tongue is drawn back, which at the same time drives the fixing members to move upwards to make the lock tongue be disengaged from the door frame to unlock, and thus the lock has the effect of the top-and-bottom latch, thereby improving the safety of the lock.

According to the top-and-bottom latch structure for a lock, the first braking piece is provided with a bump connected to the fixing member. The bump has a groove, so that the first protruding rod of the handle spindle is disposed in the groove to drive the first braking piece.

According to the top-and-bottom latch structure for a lock, the second braking piece is provided with a plate connected to the fixing member. The plate is provided with a through hole for fixing to the casing, and one end of the plate is provided with a groove, so that the second protruding rod of the handle spindle is disposed in the groove to drive the second braking piece.

DETAILED DESCRIPTION OF THE PREFERRED EMBODIMENTS

Figure 1:
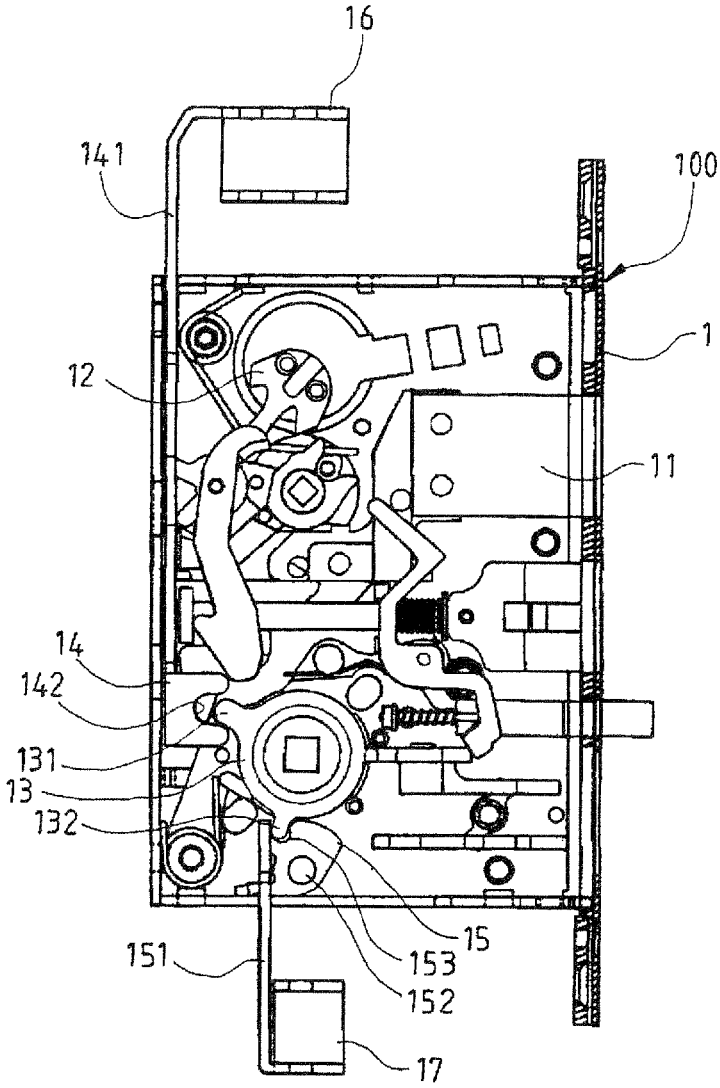
FIG. 1 is a structural view of the present invention.
Figure 2:
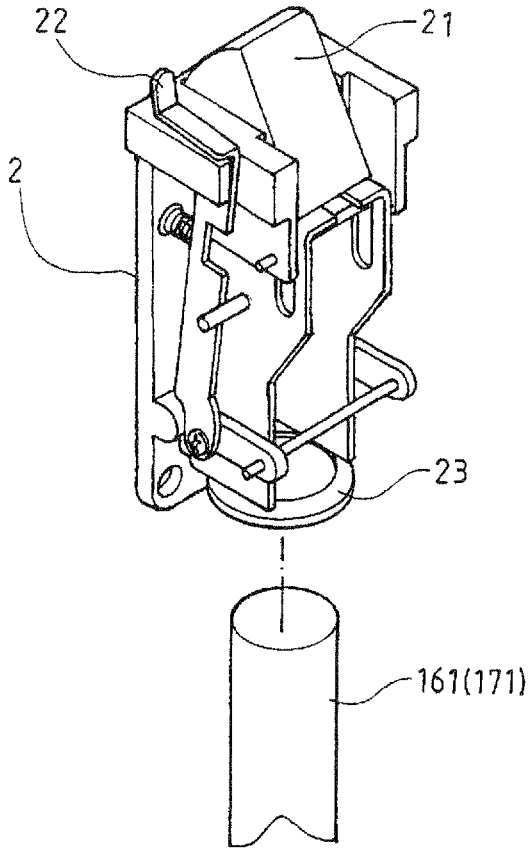
FIG. 2 is a stereogram of a tact switch of the present invention.
Figure 3:
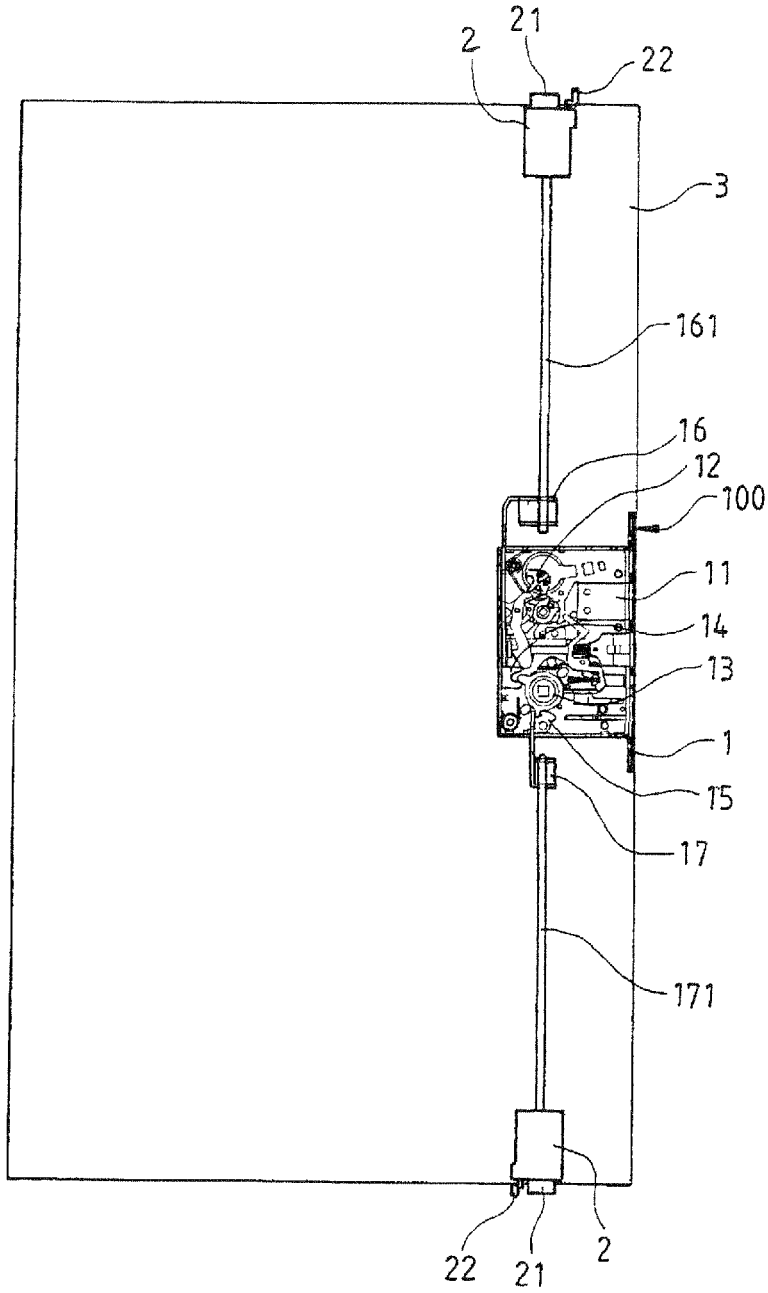
FIG. 3 is an assembling schematic view of the present invention.

FIGS. 1, 2, and 3 are respectively a structural view, a stereogram of a tact switch, and an assembling schematic view of the present invention. As shown in the figures, the present invention includes a lock 100 formed by a casing 1, and a lock tongue 11, a lock core 12, a handle spindle 13, and other components disposed in the casing 1, and further includes tact switches 2 disposed on upper and lower edges of a door panel. The handle spindle 13 is provided with a first protruding rod 131 and a second protruding rod 132 disposed at different angles, and is respectively provided with a first braking piece 14 above the handle spindle 13 and a second braking piece 15 below the handle spindle 13, so that the first and second braking pieces 14, 15 are respectively clamped by the first and second protruding rods 131, 132. The first and second braking pieces 14, 15 are respectively connected to fixing members 16, 17 above and below the casing 1 by connecting rods 141, 151.

The first braking piece 14 is provided with a bump connected to the fixing member 16 via the connecting rod 141. The bump has a groove 142, so that the first protruding rod 131 of the handle spindle 13 is disposed in the groove 142 to drive the first braking piece 14.

The second braking piece 15 is provided with a plate connected to the fixing member 17 via the connecting rod 151. The plate is provided with a through hole 152 for fixing to the casing, and one end of the plate has a groove 153, so that the second protruding rod 132 of the handle spindle 13 is disposed in the groove 153 to drive the second braking piece 15.

The tact switch 2 is provided with a lock tongue 21 and a catching plate 22 interlocked with the lock tongue 21, and is provided with a fixing ring 23 on the bottom thereof.

By the above combination of components, after the lock 100 is installed on the door panel 3, the two fixing members 16, 17 are respectively connected to the first and second braking pieces 14, 15 via the connecting rods 141, 151, and the fixing members 16, 17 are respectively connected to the fixing rings 23 of the tact switches 2 on the door panel 3 via connecting rods 161, 171. When the door is closed, since the catching plate 22 of the tact switch 2 touches the door frame, the lock tongue 21 is embedded in the door frame, and the fixing ring 23 moves downwards, thereby making the fixing members 16, 17 move downwards, so that the lock core 12 rotates to lock the lock tongue 11. When the handle spindle 13 is pressed down, the lock tongue 11 is drawn back, which at the same time drives the fixing members 16, 17 to move upwards to make the lock tongues 21 be disengaged from the door frame to unlock, and thus the lock has the effect of the top-and-bottom latch, thereby improving the safety of the lock.

Figure 4:
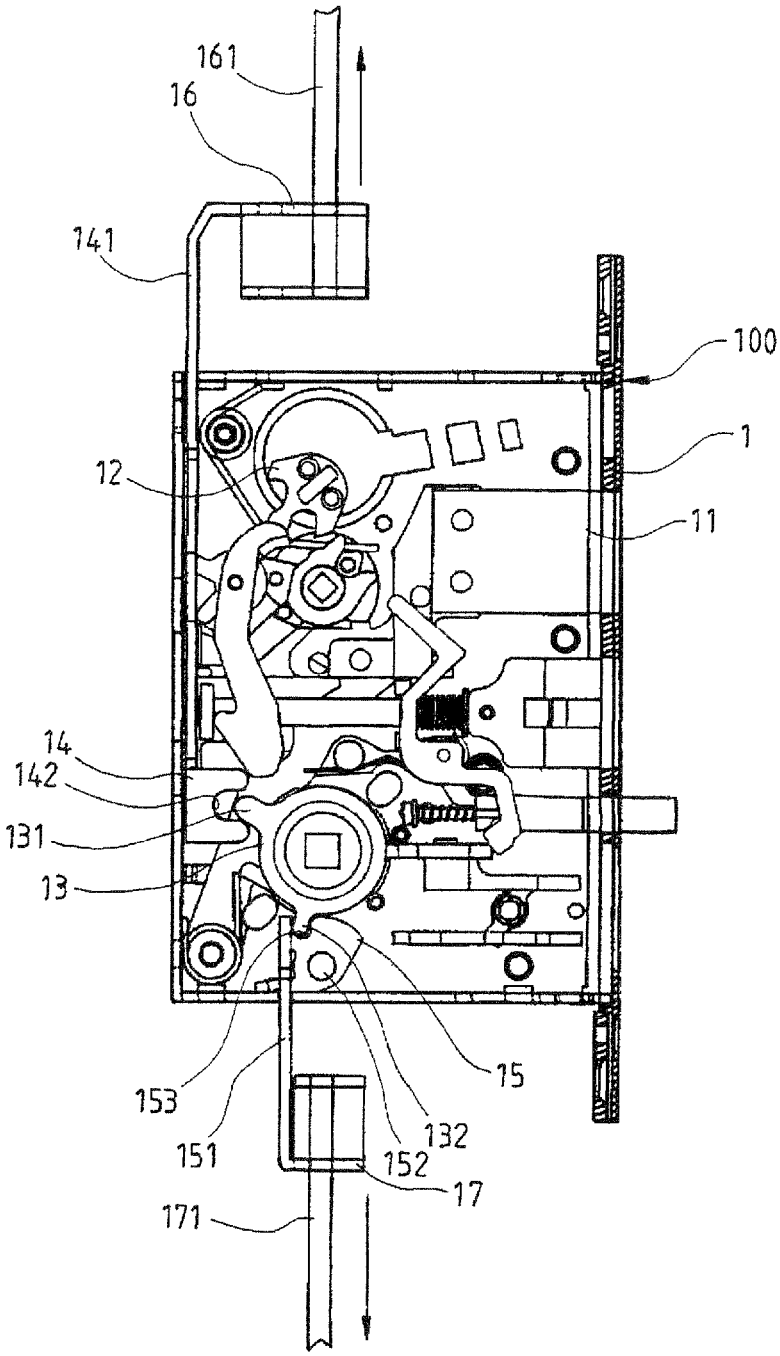
FIG. 4 is a schematic view illustrating locking motions of the present invention.

FIG. 4 is a schematic view illustrating locking motions of the present invention. Referring to FIGS. 2 and 3 together, when the door is closed, the catching plates 22 of the tact switches 2 disposed on the upper and lower edges of the door panel 3 touch the door frame, and are pressed inwards by the door frame. Accordingly, the lock tongues 21 tilt upwards to be embedded into the door frame, and the fixing rings 23 relatively move downwards to make the fixing members 16, 17 move downwards to drive the first and second braking pieces 14, 15 to rotate the lock core 12, and further the lock tongue 11 protrudes out of the casing 1 to be locked, so that the lock has the effect of the top-and-bottom latch, thereby improving the safety of the lock.

Figure 5:
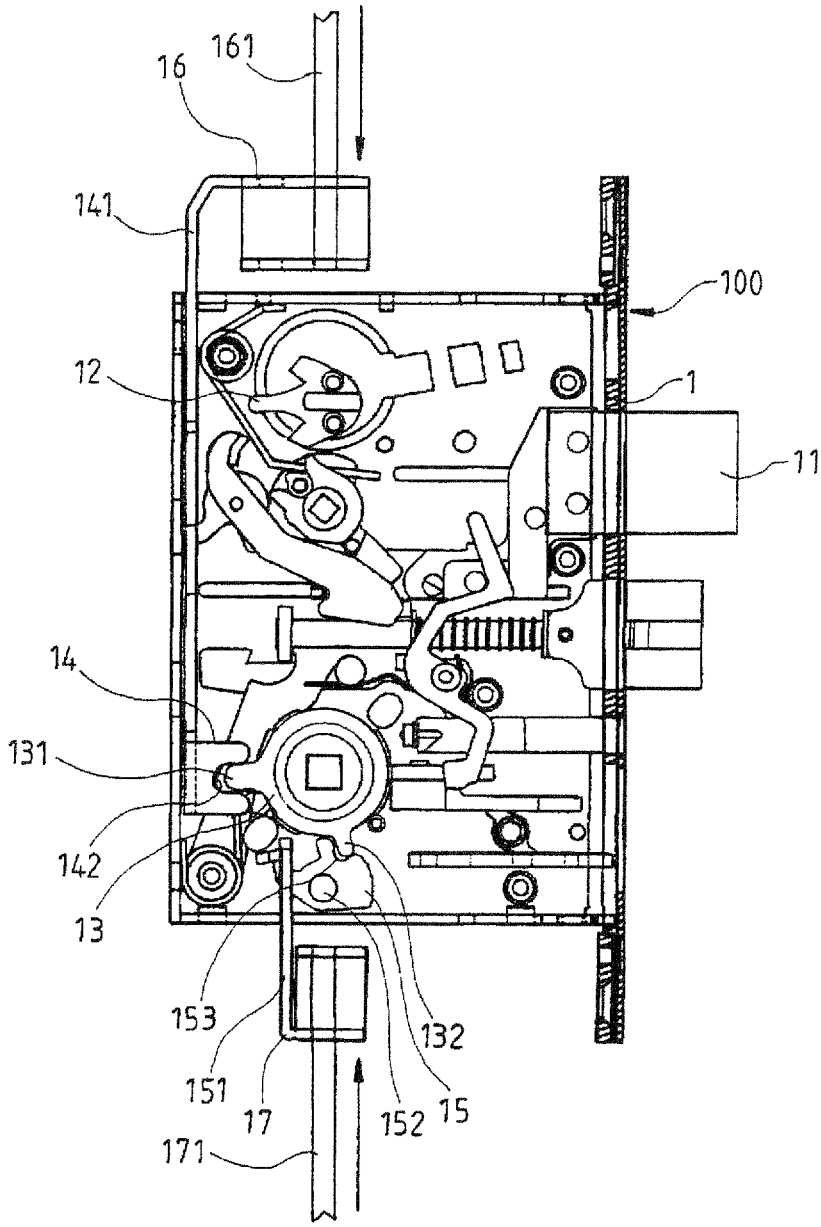
FIG. 5 is a schematic view illustrating unlocking motions of the present invention.

FIG. 5 is a schematic view illustrating unlocking motions of the present invention. Referring to FIGS. 2 and 3 together, when the handle spindle 13 is pressed down, the original motion of the lock 100 is making the lock tongue 11 drawn back, which at the same time drives the first and second braking pieces 14, 15 to further drive the fixing members 16, 17 move upwards, so that the lock tongues 21 of the tact switches 2 are pushed upwards due to the fixing rings 23, which are converted into the flat state to be disengaged from the door frame to unlock.

While the present invention have been described with reference to certain preferred embodiments, those of skill in the art will appreciate that the above preferred embodiments are only intended to explain the present invention and does not limit the protection scope of the present invention. Various modifications, equivalent replacements, improvements and so on without departing from the spirit and scope of the invention as recited in the claims, are all included in the rights protection scope of the present invention.

In view of the above, in the present invention, the lock having braking pieces and fixing members is used together with the tact switches of the door panel to constitute the top-and-bottom latch structure for a lock, so that the lock in use has the locking effect of the top-and-bottom latch, thereby improving the safety of the lock. The present invention meets the practicability requirement, and is a novel invention, so is filed for granting with the patent.

We claim:

1. A top-and-bottom latch structure for a lock, comprising a lock formed by a casing mounted to a door panel, and a primary lock tongue, a lock core, and a handle spindle that is operatively coupled to the primary lock tongue via the lock core disposed in the casing, and tact switches disposed on upper and lower edges of the door panel, each of tack switches comprising a secondary lock tongue and a catching plate that has a portion engageable with a door frame associated with the door panel, wherein:

the handle spindle is provided with a first and a second protruding rod disposed at different angles, and is provided with a first braking piece above the handle spindle and a second braking piece below the handle spindle, so that the first and second braking pieces are respectively coupled to the first and second protruding rods and thus the handle spindle, and the first and second braking pieces are respectively connected to fixing members above and below the casing by first connecting rods; the fixing members are connected to the tact switches of the door panel respectively by second connecting rods; when the door is closed, the tact switches are moved with the door panel toward the door frame, whereby the secondary lock tongues of the tact switches are embedded into the door frame and the catching plates are brought into engagement with the door frame to drive, via the second connecting rods, the fixing members toward the lock to rotate the handle spindle in a first rotation direction for extending, via the lock core, the primary lock tongue out to effect locking; and when the handle spindle is rotated in a second, opposite rotation direction, the primary lock tongue is drawn back, and the fixing members are driven, via the coupling between the first and second protruding rods and first and second braking pieces, to move toward the tact switches so as to make the second lock tongues of the tact switches disengage from the door frame to unlock.

2. The top-and-bottom latch structure for a lock of claim 1, wherein the first braking piece is provided with a bump connected to the fixing member via the connecting rod, and the bump has a groove, so that the first protruding rod of the handle spindle is disposed in the groove to drive the first braking piece.

3. The top-and-bottom latch structure for a lock of claim 1, wherein the second braking piece is provided with a plate connected to the fixing member via the connecting rod, and one end of the plate has a groove, so that the second protruding rod of the handle spindle is disposed in the groove to drive the second braking piece.

* * * * *